US009982205B2

(12) United States Patent
Pichach

(10) Patent No.: US 9,982,205 B2
(45) Date of Patent: May 29, 2018

(54) SUBTERRANEAN GASIFICATION SYSTEM AND METHOD

(71) Applicant: Craig Pichach, Calgary (CA)

(72) Inventor: Craig Pichach, Calgary (CA)

( * ) Notice: Subject to any disclaimer, the term of this patent is extended or adjusted under 35 U.S.C. 154(b) by 49 days.

(21) Appl. No.: 14/816,201

(22) Filed: Aug. 3, 2015

(65) Prior Publication Data

US 2017/0037719 A1 Feb. 9, 2017

(51) Int. Cl.

| | |
|---|---|
| ***C10J 3/00*** | (2006.01) |
| ***C10J 3/20*** | (2006.01) |
| ***E21B 43/00*** | (2006.01) |
| ***C10J 1/00*** | (2006.01) |

(52) U.S. Cl.
CPC ..... *C10J 1/00* (2013.01)

(58) Field of Classification Search
CPC ..... E21B 43/295; C10J 3/00
See application file for complete search history.

(56) References Cited

U.S. PATENT DOCUMENTS

| | | | | |
|---|---|---|---|---|
| 3,605,890 | A * | 9/1971 | Holm | E21B 43/243 166/261 |
| 4,250,230 | A * | 2/1981 | Terry | E21B 43/00 166/261 |
| 4,476,927 | A * | 10/1984 | Riggs | E21B 43/243 166/261 |
| 8,051,908 | B2 | 11/2011 | Pfeiffer | |
| 8,327,932 | B2 | 12/2012 | Karanikas | |
| 8,733,459 | B2 | 5/2014 | Wallace | |
| 9,222,704 | B2 * | 12/2015 | McAlister | B01J 19/0053 |
| 9,512,759 | B2 * | 12/2016 | Muthaiah | F02C 3/34 |
| 2004/0033557 | A1 | 2/2004 | Scott | |
| 2006/0150640 | A1 * | 7/2006 | Bishop | F17C 1/007 62/53.1 |
| 2007/0223999 | A1 * | 9/2007 | Curlett | E21B 43/17 405/55 |
| 2013/0008772 | A1 | 1/2013 | Fritz | |
| 2013/0180708 | A1 * | 7/2013 | Ware | E21B 43/2406 166/246 |
| 2014/0206912 | A1 | 7/2014 | Iglesias | |

* cited by examiner

*Primary Examiner* — Matthew J Merkling
(74) *Attorney, Agent, or Firm* — Lewellyn Law, PLLC; Stephen Lewellyn

(57) ABSTRACT

A system and method for gasification of a feedstock in a subterranean formation to produce syngas is described. An injection well is completed in the formation to inject an oxidant, provide an ignition source and convey the feedstock that includes water and one or more of a biomass, waste plastic, coal, bitumen and petcoke. Volatized hydrocarbons and gaseous reaction products are simultaneously withdrawn from a producer well from the subterranean formation to the surface. This syngas product is treated at the surface for power generation or conversion to transportation fuels and/or plastics. This method provides a low capital cost gasification unit which is capable of processing a variety of feedstock mixtures.

15 Claims, 4 Drawing Sheets

SUBTERRANEAN GASIFICATION SYSTEM AND METHOD

FIELD OF THE INVENTION

The present invention relates generally to subterranean gasification, and more particularly, relating to a subterranean gasification system and method for the gasification of slurry injected into a subterranean formation and recovering syngas as a product of the gasification of the slurry.

BACKGROUND OF THE INVENTION

Gasification of organic material (biomass) or fossil fuel carbonaceous material (coal) into syngas is known. The gasification process converts these materials into a gaseous mixture including carbon monoxide, hydrogen, carbon dioxide and methane. This gaseous mixture is called syngas and is commonly used as a combustible fuel or in the manufacture of derivate products.

Biomass gasification is generally conducted at the surface using gasifiers that are specially designed for biomass gasification. Coal gasification of mined coal may also be conducted at the surface using gasifiers that are specially designed for coal gasification. Non-mined coal may also be gasified using a process called in-situ coal gasification (ISCG), also referred to underground coal gasification, where coal is gasified in non-mined seams to produce syngas and methane.

SUMMARY OF THE INVENTION

The system and method described herein provide a low cost, flexible feedstock method for the subterranean gasification of biomass, waste plastics, coal, bitumen, petcoke, or combinations thereof under pressure. The described system and method not only provides for a mechanism to generate renewable syngas for fuel and plastic processing but also the ability to dispose of waste without surface land fill. Objects of the present invention are accomplished through utilization of a system and method for the recovery of volatile hydrocarbons and a synthetic gas having a high calorific energy value from gasification of feedstock in a subterranean formation.

In general, in one aspect a subterranean gasification method is provided. The method includes: completing an injection well and a production well in a suitable formation; injecting a feedstock and an oxidant through the injection well into the formation; causing gasification of the feedstock in the formation; and recovering syngas from the formation through the production well.

The method may also include one or more of: injecting a blanket fluid through said injection well; injecting a blanket fluid through said production well; recovering methane from said formation through said production well; injecting water into said formation through said production well; injecting a combustion supporting fuel into said formation through said injection well; and causing a water-gas shift reaction in said formation between said combustion supporting fuel and water, for example.

Additionally, in embodiments the feedstock may include water and one or more of the group consisting of biomass, petcoke, coal, and waste plastic. Further, in embodiments, the formation may be depleted hydrocarbon reservoir, a depleted coal seam, or a deep salt cavern.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Embodiments of the invention provide subterranean gasification of a feedstock slurry injected into a formation through an injection well and recovery of volatile hydrocarbons, syngas, or both from the gasification of the feedstock through a production well. The feedstock slurry is comprised of material that may be gasified in the formation. In the following discussion, the feedstock slurry may be referred to as the slurry or feedstock interchangeably.

The feedstock includes biomass, waste plastics, coal, bitumen, petcoke or combinations thereof admixed with water. In aspects, biomass includes plant or animal based biological material derived from living or recently living organisms. The addition of coal, bitumen, petcoke, or a combination thereof to the biomass may increase the heating value of the biomass. The feedstock is prepared at the surface utilizing methods or devices known in the art used to produce feedstock for surface gasifiers.

The feedstock along with an oxidant is injected into the formation for gasification within the formation. Gasification of the feedstock is achieved by reacting the feedstock at high temperatures (>700° C.) with a controlled amount of oxygen and/or steam. The oxygen supports a limited amount of combustion, which heats up the feedstock and boils both the natural formation water present along with injected water, to generate steam. In essence, a limited amount of oxygen or air is introduced into the reactor to allow some of the organic material to be "burned" to produce carbon dioxide and energy, which drives a second reaction that converts further organic material to hydrogen and additional carbon dioxide.

The water can be saline as opposed to fresh water. The resultant conditions (high temperature, high pressure by virtue of the formation depth, and the presence of steam) cause a number of chemical reactions to occur whereby the injected feedstock slurry is converted into a gas, which consists primarily of synthesized methane, carbon dioxide, hydrogen and carbon monoxide. This gas is then conducted up to the surface via the vertical production well, where the gas can then be processed.

It is contemplated that a benefit may be gained by replacement of some or all of the slurry water with supercritical CO2 with lower viscosity and density.

Figure 1:
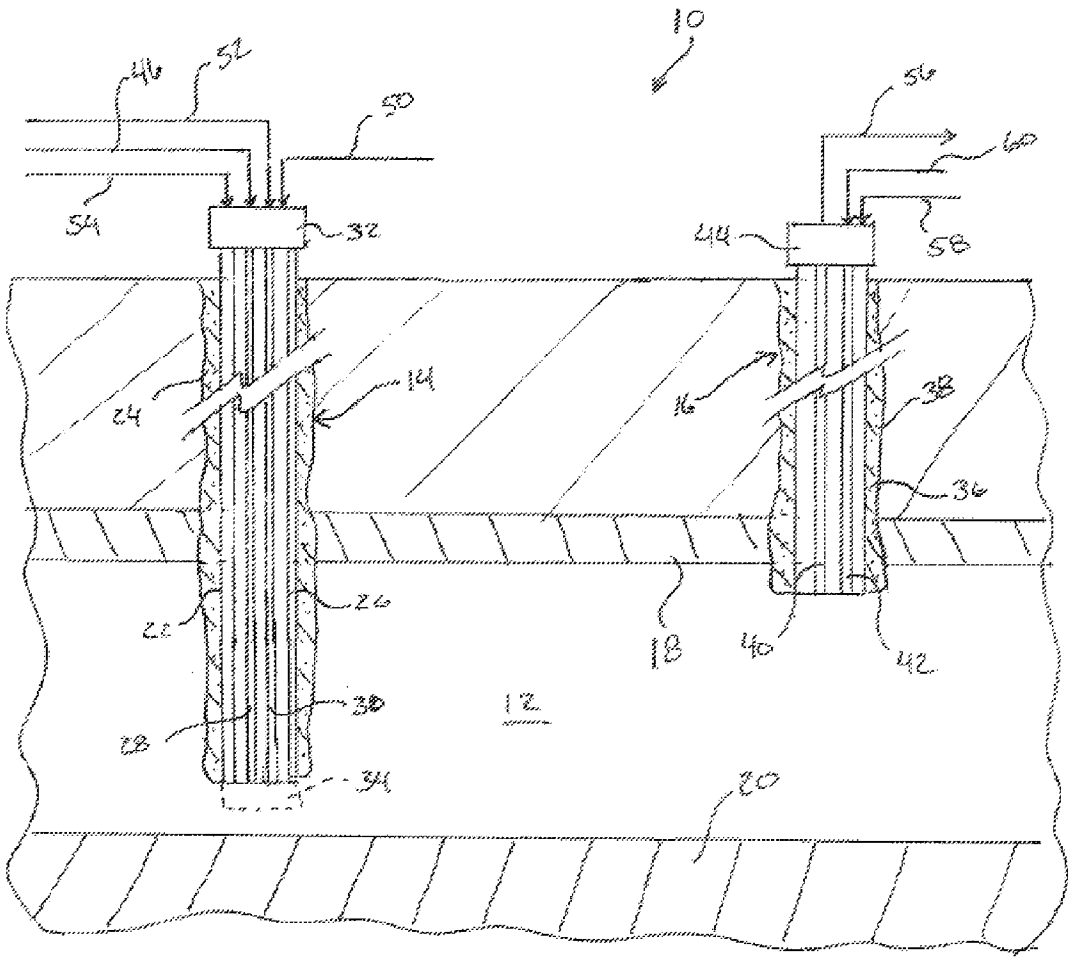
FIG. 1 is a diagrammatic view of a subterranean gasification system (gasifier) constructed in accordance with the principles of an embodiment the present invention.
Figure 3:
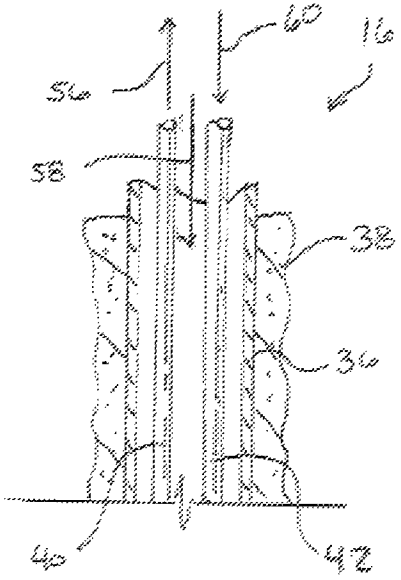
FIG. 3 is a diagrammatic, partial view of a production well of the gasifier of FIG. 1.
Figure 2:
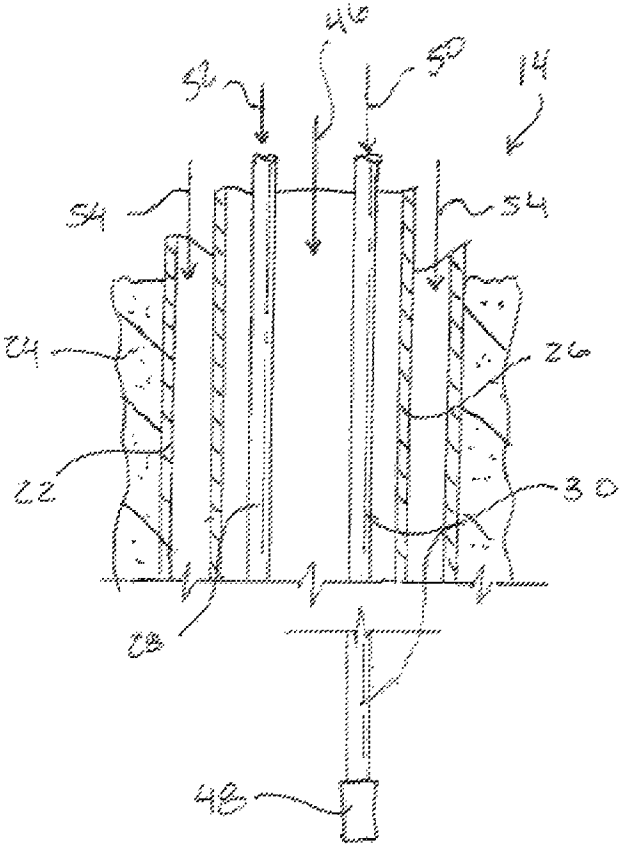
FIG. 2 is a diagrammatic, partial view of an injection well of the gasifier of FIG. 1.

With reference to FIGS. 1-3 there is representatively illustrated a subterranean gasification system 10 in accordance with an embodiment of the invention. The gasification system 10 includes a suitable subterranean formation 12, an injection well 14, and a production well 16.

The subterranean formation 12 must be suitable to support gasification. A suitable subterranean formation 12 may include a depleted oil and gas reservoir, a depleted coal seam, or a depleted salt cavern, for example, of suitable integrity. A formation of suitable integrity preferably includes a formation that is of a certain depth and with adequate overburden and underburden formation rock 18 and 20, respectively, to prevent fluid migration into groundwater. The formation must also have a sufficient permeability and porosity to allow syngas to migrate through the formation from the injection well 14 to the production well 16. It is contemplated that a formation with limited permeability but otherwise having suitable overburden and underburden formation rock might benefit from hydraulic fracking to encourage communication between the injection and the production wells.

The injection well 14 is shown run into the formation 12 and completed. The injection well includes a casing 22 that is preferably cemented 24 to retain it in place and to prevent fluid migration between subsurface formations. The injection well 14 further includes a feedstock string 26, an oxidant string 28, an igniter string 30, and a wellhead 32. The feedstock string 26 is run into the casing 22, and the oxidant string 28 and the igniter string 30 are run into the feedstock string 26.

As shown, the injection well 14 has an openhole completion. In embodiments, the injection well 14 may be completed with a downhole nozzle assembly 34 (shown in broken line) connected to the oxidant string 28 and possibly the feedstock string 26 to promote atomization of the feedstock and oxidant to further promote gasification.

Additionally, while injection well 14 is shown as a vertical well, in certain instances where ash or soot accumulation could be problematic, the injection well could be formed as a horizontal well and could include casing or another string portion extending beyond the end of the oxidant string 28 to prevent soot from impeding injection.

The production well 16 is shown run into the formation 12 and completed. The production well includes a casing 36 that is preferably cemented 38 to retain it in place and to prevent fluid migration between subsurface formations. The production well 16 further includes a syngas string 40 and a water string 42 that are run into the casing 36, and a wellhead 44. As shown, the production well 16 has an openhole completion. In certain instances where the formation has high permeability, porosity, or both the production string 16 can be completed with a gravel or prop pack, or with a slotted liner or wire wrapped screen (not shown).

As further shown, the injection string 14 is completed so as to be in communication with a lower section of the formation 12, while the production string 16 is completed so as to be in communication with an upper section of the formation. This arrangement is to encourage gasification to flow in a general vertical direction from the bottom of the formation toward the top of the formation 12 and in a horizontal direction from the injection well 14 toward the production well 16.

With reference to the injection well 14, feedstock 46 is pumped from the surface down the feedstock string 26 and into the formation 12. Similarly, an oxidant 52 is injected into the formation 12 through the oxidant string 28. While atmospheric air could be used the oxidant, oxygen is the preferred oxidant because the produced syngas will not contain nitrogen. The igniter string 30 may be fitted with a downhole ignitor 48, and in certain embodiments may provide for the injection of combustion fuel 50 into the formation 12 to initiate combustion within the formation to support gasification of the feedstock 46. A water-gas shift reaction between the combustion fuel and water in the formation may be caused to increase the calorific content of produced gas. A blanket fluid 54, such as water or a non-condensable gas, is injected into the casing 22 to prevent fluid in the formation 12 from flowing upward through the casing, to cool the casing and to also monitor formation (downhole) pressure.

With reference to the production well 16, gas 56 formed in the formation by the gasification of the feedstock 46 is recovered at the surface through syngas string 40. Gas 56 is primarily syngas, but can also include other gas depending on the components of the feedstock. For example, gas 56 could also include methane as a result of anaerobic digestion of biomass contained in the feedstock. Similar to the injection well 14, blanket fluid 58, such as water or non-condensible gas, is injected into the casing 36 for cooling and to prevent fluid in the formation 12 from flowing upward through the casing. Additionally, water 60 can be injected into the formation 12 through water string 42 to quench the formation if the process needs to be shut down or to further cool and clean the syngas.

Figure 4:
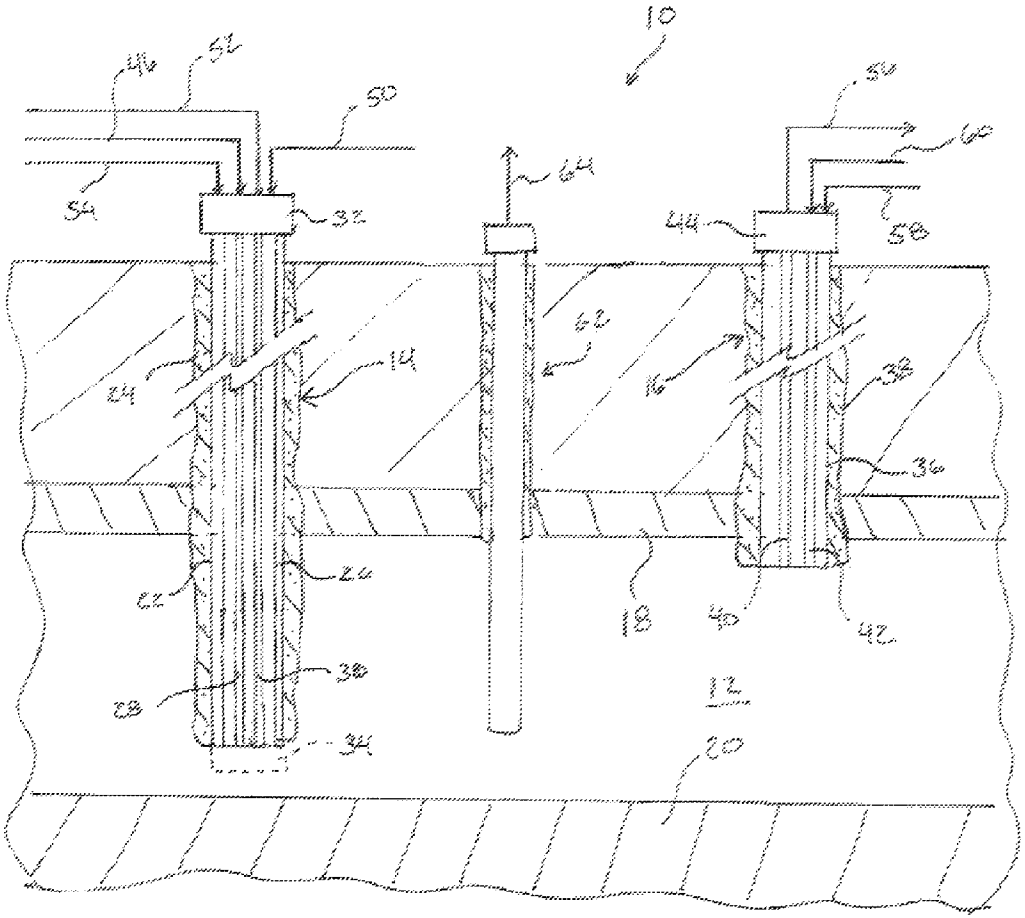
FIG. 4 is a diagrammatic view of a subterranean gasification system (gasifier) constructed in accordance with the principles of an alternative embodiment the present invention.

With reference to FIG. 4, gasification system 10 is shown with a fluid production well 62 run into the formation 12 and completed. In some iterations this may be accomplished with an additional string on the syngas production well. It may be desirable to include fluid production well 62 in order to pump liquid such as slag/ash slurry and/or Pyrolysis liquids 64 from the formation 12 to promote gasification within the formation that would otherwise be hindered by built up solids and/or liquids. This is done by shutting down the gasifier and purging the well with high pressure water. This can alternatively be accomplished on-line through gas-lift or similar downhole pump.

Figure 5:
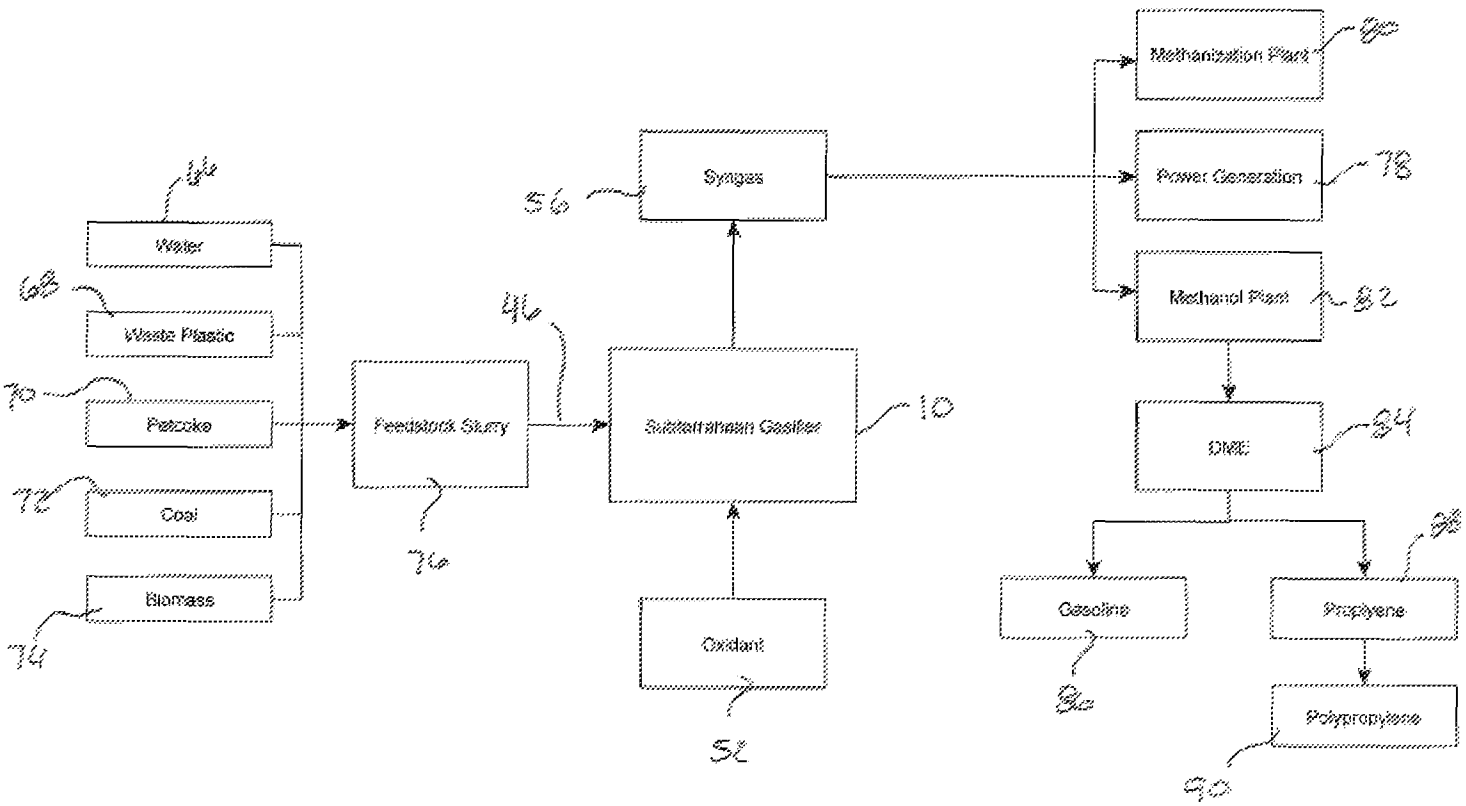
FIG. 5 is a diagrammatic view of a gasification process including a subterranean gasifier in accordance with the principles of an embodiment of the present invention.

In FIG. 5 there is illustrated a block diagram of an exemplary gasification process including the gasification system 10. The process illustrates gasification of a feedstock 46 with the system 10 to produce syngas 56 and then using the syngas in various downstream systems or plants.

Particularly, various feedstock components including water 66 and one or more of waste plastic 68, petcoke 70, coal 72, and biomass 74 are feed to a feedstock preparation system 76 where the components and water are processed into feedstock slurry 46. The feedstock 46 and oxidant 52 are injected into gasifier 10. The feedstock 46 is gasified and syngas 56 is recovered from the gasifier 10. The syngas 56 can be directly used, by a power generation plant 78 to produce electricity, for example. In addition or alternatively to power generation, the syngas 56 can be processed by methanization plant 80, methanol plant 82, or both. Additionally, product from the methanol plant 82 can be further processed to produce dimethyl ether 84, which in turn can be used to produce gasoline 86 or propylene 88 and then polypropylene 90. It is worth noting that excess CO2 can be converted to methanol potentially with hydrogen in the methanol plant 80.

Other embodiments are possible. For example, in some cases where biomass slurry will be the only feedstock it could be of benefit to modify the injector well design to accommodate anaerobic digestion in lieu of a gasification reaction. The oxidant injector string and ignitor are not required, the oxidant string is instead replaced with a downhole gas production string. The producer well for anaerobic digestion may not be required. Anaerobic digestion is a collection of processes by which microorganisms break down biodegradable material in the absence of oxygen. There are four key biological and chemical stages of anaerobic digestion—hydrolysys, acidogenesis, acetogenesis and methogenesis. A simplified generic chemical equation for the overall processes outlined above is as follows: $C_6H_{12}O_6 \rightarrow 3CO_2 + 3CH_4$. The process produces a biogas, consisting of methane, carbon dioxide and traces of other 'contaminant' gases. Methogenesis is sensitive to both high and low pH and occurs between pH 6.5 and pH 8 that the pH of the feedstock may require adjustment through use of a base or acid at surface. The remaining, indigestible material the microbes cannot use and any dead bacterial remains constitute the digestate which may be pumped to surface using a producer well if able to build up within the formation. In some cases the two processes can be combined in which methogenesis is encouraged beyond the high temperature gasification reaction in the formation through occasional shutting down of the gasifier and the downhole pumping of slurry to encourage anerobic digestion outside the gasification reaction zone and in the formation matrix.

A number of embodiments of the present invention have been described. Nevertheless, it will be understood that various modifications may be made without departing from the spirit and scope of the invention. Accordingly, other embodiments are within the scope of the following claims.

What is claimed is:

1. A subterranean gasification method comprising the steps of:

completing an injection well and a production well in a suitable formation;

injecting a feedstock and an oxidant through said injection well into said formation;

causing gasification of said feedstock in said formation with said feedstock in contact with said formation; and recovering syngas from said formation through said production well.

2. The method of claim 1, further comprising:

injecting a fluid through said injection well.

3. The method of claim 1, further comprising:

injecting a blanket fluid through said production well.

4. The method of claim 1, further comprising:

recovering methane from said formation through said production well.

5. The method of claim 1, wherein said feedstock includes water and one or more of the group consisting of biomass, petcoke, coal, and waste plastic.

6. The method of claim 1, wherein said feed stock includes water and biomass.

7. The method of claim 1, wherein the oxidant is oxygen.

8. The method of claim 1, wherein said formation is a depleted hydrocarbon reservoir.

9. The method of claim 1, wherein said formation is a depleted coal seam.

10. The method of claim 1, wherein said formation is a deep salt cavern.

11. The method of claim 1, further comprising:

hydraulic fracking said formation.

12. The method of claim 1, further comprising:

injecting water into said formation through said production well.

13. The method of claim 1, further comprising:

injecting a combustion supporting fuel into said formation through said injection well.

14. The method of claim 13, further comprising:

causing a water-gas shift reaction in said formation between said combustion supporting fuel and water.

15. The method of claim 1, further comprising:

completing a fluid production well in said formation; and recovering fluid from said formation through said fluid production well.

* * * * *